United States Patent [19]

Lukac et al.

[11] 4,138,273

[45] Feb. 6, 1979

[54] METHOD FOR CLEANING STRIP

[75] Inventors: Frederick S. Lukac, New Kensington; William P. Zbryski, Tarentum, both of Pa.

[73] Assignee: Allegheny Ludlum Industries, Inc., Pittsburgh, Pa.

[21] Appl. No.: 881,202

[22] Filed: Feb. 27, 1978

Related U.S. Application Data

[62] Division of Ser. No. 769,496, Feb. 17, 1977, Pat. No. 4,093,472.

[51] Int. Cl.[2] ..... B08B 1/02; B08B 3/00

[52] U.S. Cl. ..... 134/10; 134/15; 134/34

[58] Field of Search ..... 134/2, 10, 15, 34, 107, 134/108

[56] References Cited

U.S. PATENT DOCUMENTS

| | | | |
|---|---|---|---|
| 2,089,648 | 6/1937 | Gordon | 134/10 |
| 2,529,762 | 11/1950 | Brisse | 134/10 |
| 2,738,294 | 3/1956 | Spence | 134/15 |
| 3,108,025 | 10/1963 | Gutterman | 134/15 |
| 4,078,942 | 3/1978 | Luisi et al. | 134/15 |

*Primary Examiner*—S. Leon Bashore

*Assistant Examiner*—Chris Konkol

*Attorney, Agent, or Firm*—Vincent G. Gioia; Robert F. Dropkin

[57] ABSTRACT

A strip is continuously passed through a molten salt bath in a main tank having a central longitudinal baffle providing passageways at each end thereof. A sink guide roll is provided for the strip at the exit half of the tank. A heating tank is located along one longitudinal side of the main tank at the entry end thereof and has front and rear connecting openings with the main tank. An agitator is positioned at the front end of the heating tank. A forward tank section located along the other side of the tank has a bottom opening connecting therewith. An intermediate tank section has upper and lower compartments, the upper compartment serving as a sludge settling basin. A rear tank section has an agitator therein and is connected to the forward tank section through the lower compartment. Small openings adjacent the top of the upper compartment open into the main tank and to the rear tank section. The bath is continuously circulated from the rear tank section back around the baffle, forward into the rear end of the heating tank, through the heating tank and across the front end of the main tank into the forward tank section and then back into the rear tank section.

1 Claim, 7 Drawing Figures

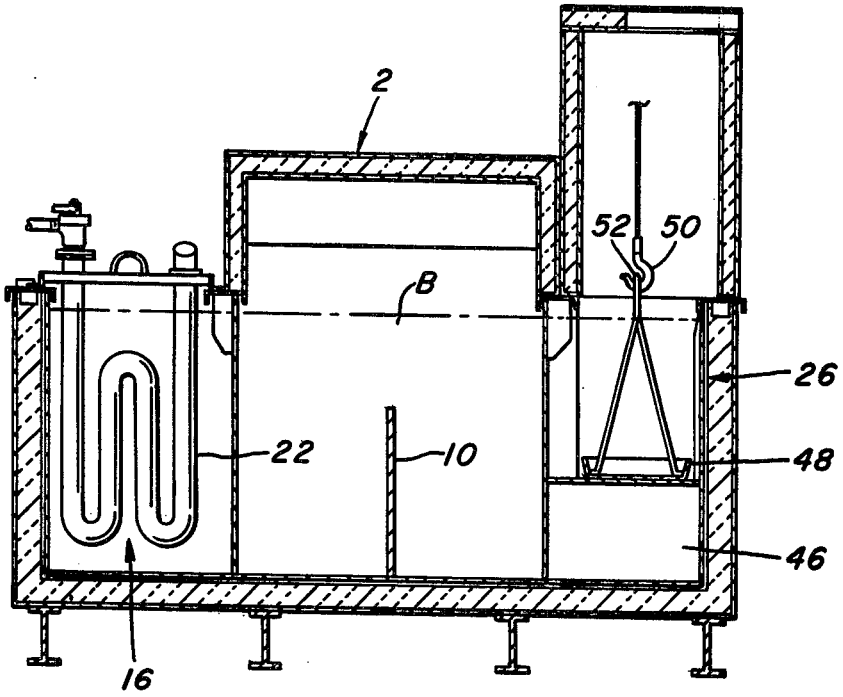
FIG. 2.
FIG. 3.
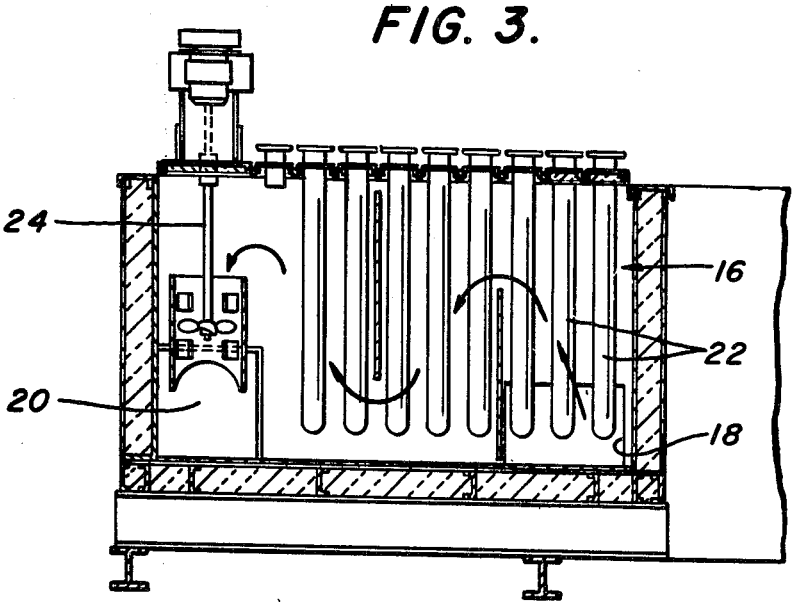

METHOD FOR CLEANING STRIP

This is a division of application Ser. No. 769,496, filed Feb. 17, 1977, now U.S. Pat. No. 4,093,472.

This invention relates to a method and apparatus for cleaning strip and particularly to cleaning stainless steel strip by passing it continuously through a tank containing molten metal salt at a temperature approximately 900° F. Such method and apparatus for cleaning metal products are old and well known, both for batch and continuous processes. Art of which we have knowledge are Faler U.S. Pat. Nos. 2,783,892 dated Mar. 5, 1957, and 3,393,689 dated July 23, 1968, Shoemaker et al. U.S. Pat. Nos. 1,863,465 dated Dec. 9, 1958 and 1,967,530 dated Jan. 10, 1961 and Sheppard U.S. Pat. No. 3,592,205 dated July 13, 1971. All of this prior art has various disadvantages. It is necessary that the sludge resulting from the cleaning operation be prevented from settling in the cleaning tank or on heating tubes which requires circulation of the bath. It is also necessary to heat the molten salt bath. Much of this prior art is suitable for batch processes, but not for continuous processes where a sink roll is required in the salt bath tank. For example, some of the art requires that heating, and/or sludge removal equipment and/or the salt addition zone extend substantially the full length of the tank which would make it difficult and expensive to support the sink roll. In much of the art there is poor circulation of the bath in the main tank, in the separate heating tank or around heating tubes located in the main tank. Thus, there is poor transfer of heat from the heating tubes to the bath with non-uniform heating of the bath. Poor circulation of the bath generally includes relatively quiet zones particularly in corners or near the heating tubes which will cause sludge from settling out at these locations. This is expensive to remove and can cause damage to the tank and/or heating tubes.

It is therefor an object of our invention to provide apparatus for cleaning strip passing through a molten salt bath which provides good circulation of the molten salt with resultant efficient transfer of heat from the heating tubes to the molten salt while preventing or greatly lessening settling of the sludge.

Another object is to provide a method of cleaning strip by passing it through a molten salt bath in which the bath is efficiently heated and circulated through the molten salt tank.

These and other objects will be more apparent after referring to the following specification and attached drawings in which:

FIG. 2 is a view taken on the line II—II of FIG. 1;

FIG. 3 is a view taken on the line III—III of FIG. 1,

Figure 7:
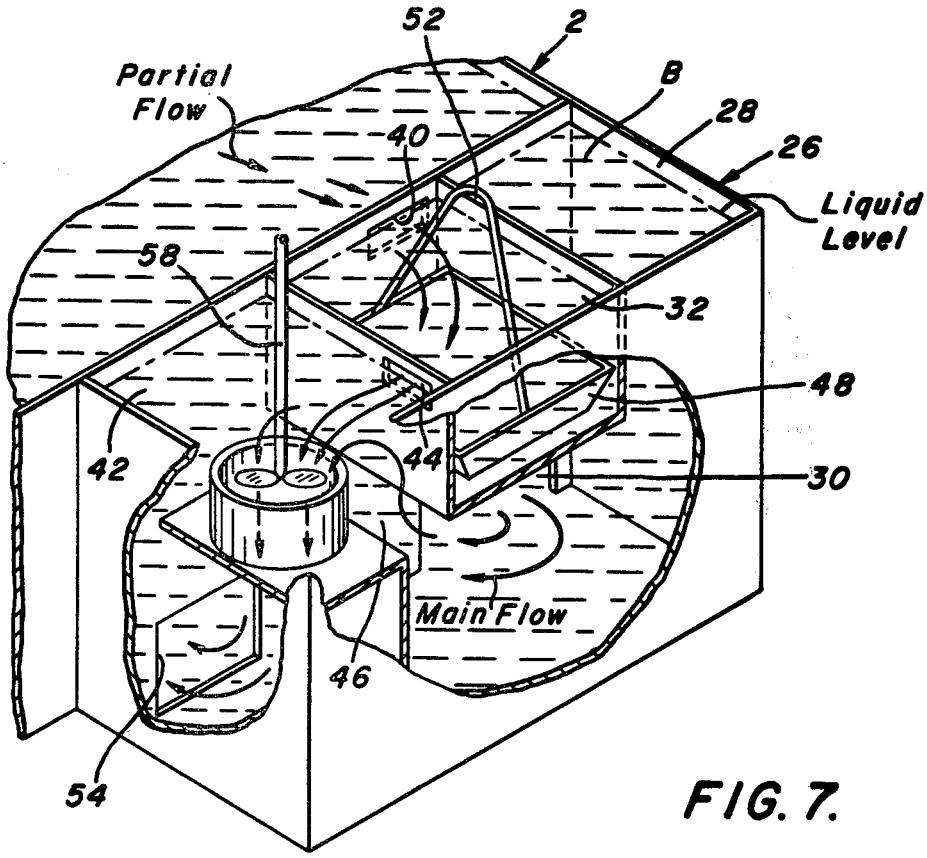
FIG. 7 is a schematic isometric view of parts of our apparatus.
Figure 4:
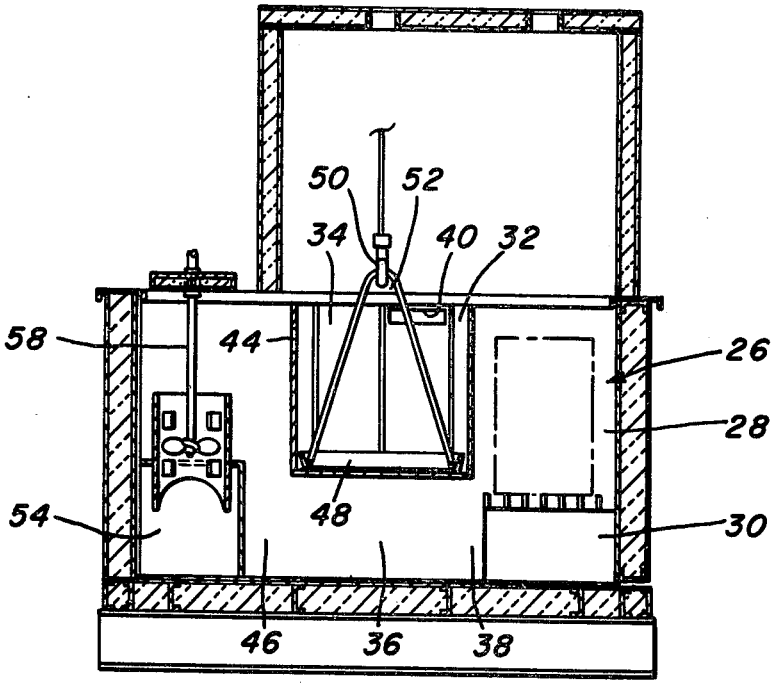
FIG. 4 is a view taken on the line IV—IV of FIG. 1.
Figure 5:
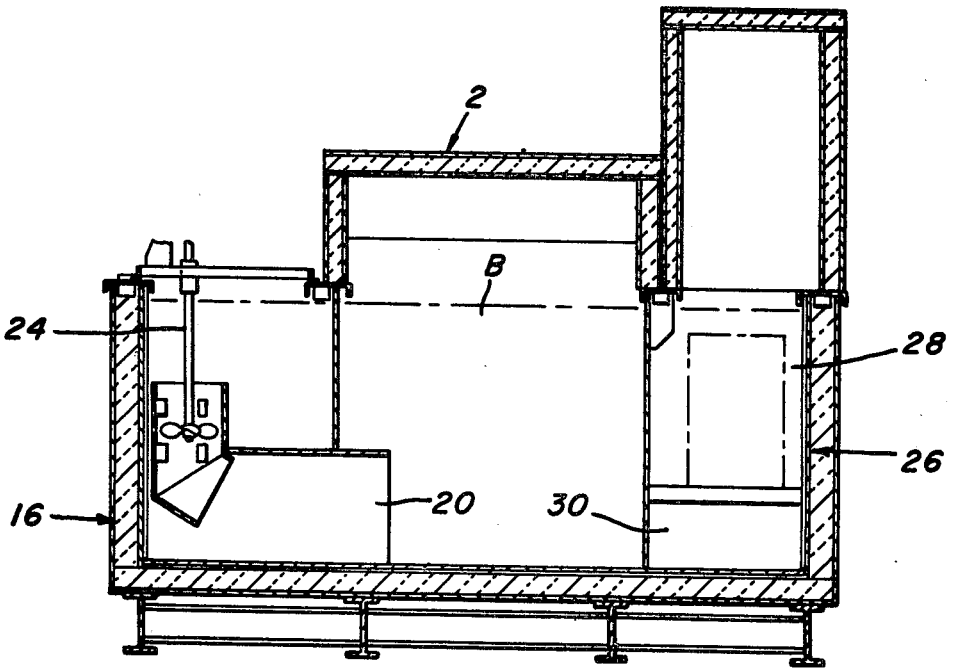
FIG. 5 is a view taken on the line V—V of FIG. 1.

Referring more particularly to the drawings, reference numeral 2 indicates a tank which contains a molten salt bath B for cleaining a strip S. The strip S passes over an entry guide roll 4 and is directed downwardly into the bath B by means of a roll 6 beneath which it passes. The strip S is then directed upwardly around the top of an exit guide roll 7. Support means 8 and 9 for rolls 6 and 7, respectively, are provided on each side of tank 2. A central vertical baffle 10 extends from the bottom of tank 2 to an elevation substantially below the top of the bath B. The baffle 10 does not extend the full length of the tank 2 so that there is a front opening 12 and a rear opening 14, each of which is preferably one half the width of tank 2. A heating tank 16 is connected to one longitudinal side of tank 2 and extends rearwardly from the entry end of tank 2 a substantial distance. At the lower rear end of tank 16 there is a passageway 18 to tank 2 and at the lower forward end of tank 16 there is a passageway 20 to the tank 2. Heating coils 22 are located in tank 16 and a circulating agitator 24 is located in tank 16 adjacent passageway 20. A third tank 26 is connected to the side of tank 2 opposite tank 16. As best shown in FIGS. 4 and 7 the tank 26 is divided into three sections. The first or forward section 28 is connected to tank 2 through an opening 30 in the lower part thereof. The second or middle section 32 has an upper compartment 34 and a lower compartment 36. The lower compartment 36 is connected to the section 28 through a bottom opening 38. The upper compartment 34 is connected to the main tank 2 through a relatively small opening 40 adjacent the top thereof and to the third or rear section 42 through a relatively small opening 44 adjacent the top thereof. The lower compartment 36 is connected to section 42 through opening 46. A removable tray 48 is positioned in compartment 34 and is removable therefrom by means of a crane (not shown) having a hook 50 adapted to engage an eye in tray bracket 52. The section 42 is connected to the main tank 2 and the fluid is directed rearwardly by means of conduit 56 through a bottom opening 54. A circulating agitator 58 is located in section 42.

Figure 1:
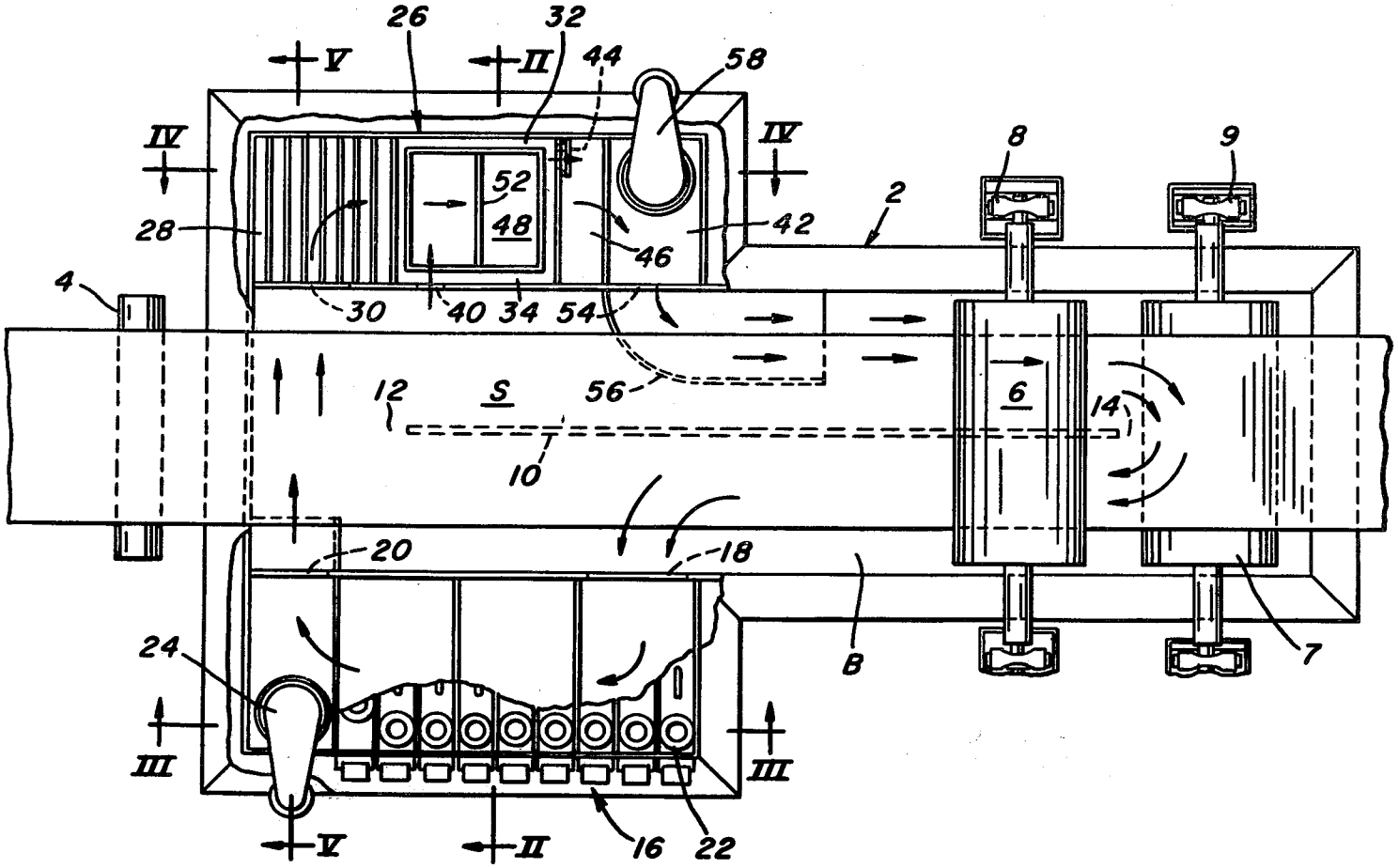
FIG. 1 is a somewhat schematic top plan view of the apparatus of our invention.
Figure 6:
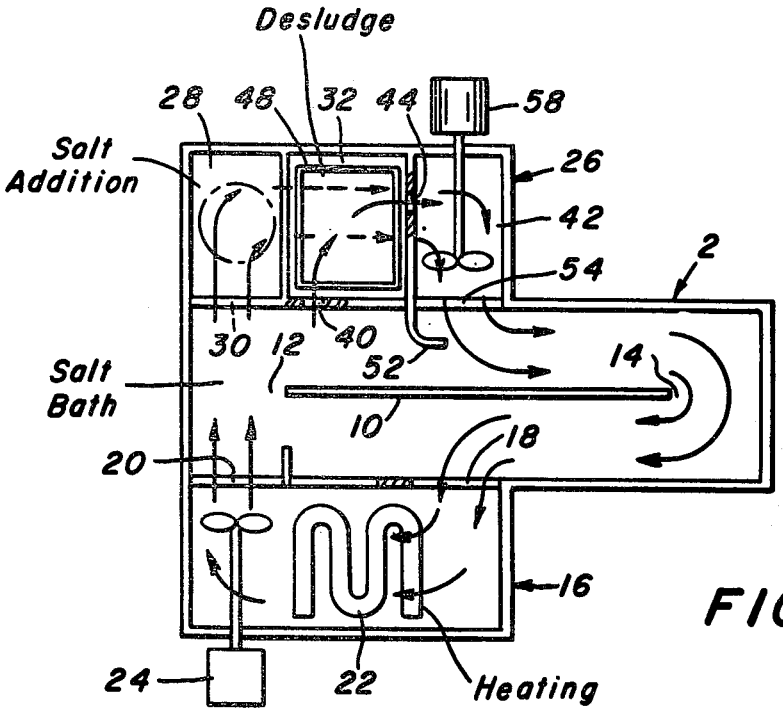
FIG. 6 is a schematic plan view of our apparatus with parts removed.

The operation of our device is as follows: The strip S is passed through the tank 2 in the usual way beneath the bath B which is continually being circulated by means of pumps 24 and 58. As best shown in FIGS. 1, 6 and 7, the molten salt passes from main tank 2 through opening 18 into tank 16 where it is heated by contact with heating coils 22. The heated salt then passes through opening 20 with a large proportion thereof passing across the tank 2 forward of the baffle 10 and through opening 30 into tank section 28 and then through compartment 36 into tank section 42. A small amount of the molten salt will pass through opening 40 into settling compartment 34. Because of the very slow flow of the molten salt in compartment 34 the sludge therein will settle out into the tray 48. From time to time as the tray 48 becomes filled with sludge it will be removed and emptied and then replaced. Salt additions are made as necessary in tank section 28. The molten salt passes out of compartment 34 through opening 44 and joins the main flow in section 42. The molten salt passes from section 42 into conduit 56 and passes rearwardly around baffle 10. It will be seen that the circulation of the molten bath as indicated by the arrows is such that the majority of the bath is in continuous movement and sludge cannot settle out except in the settling compartment. The position of agitators 24 and 58 is such that each agitator moves the bath a very substantial distance.

While there has been shown and described one embodiment, it is to be understood that various adaptations and modifications may be made within the scope of the invention.

We claim:

1. A method of cleaning strip which comprises passing said strip through a molten salt bath in a main tank having a central longitudinal baffle extending short of each end of the tank, circulating said bath from said main tank through an opening to a heating tank located along one longitudinal side of said main tank at the entry end thereof, heating said bath in said heating tank, circulating said heated bath through a bottom opening to the forward end of said main tank with the majority of said heated bath passing forward of said baffle through a bottom opening to a front tank section on the other longitudinal side of said main tank, passing said bath through a bottom opening in said front tank section through a lower compartment in an intermediate tank section to a rear tank section, passing a relatively small amount of said bath from said main tank to an upper compartment in said intermediate tank section through a small opening adjacent the top thereof, passing said bath from said upper compartment to said rear tank section through a small opening adjacent the top thereof, and circulating said bath from said rear tank section rearwardly in said main tank around the rear end of said baffle.

* * * * *